US012109502B2

(12) United States Patent
Osipov

(10) Patent No.: US 12,109,502 B2
(45) Date of Patent: Oct. 8, 2024

(54) CUBICAL 3-D MAGNETIC PUZZLE WITH MOVABLE SECTORS

(71) Applicant: Ilya V. Osipov, Nizhny Novgorod (RU)

(72) Inventor: Ilya V. Osipov, Nizhny Novgorod (RU)

( * ) Notice: Subject to any disclaimer, the term of this patent is extended or adjusted under 35 U.S.C. 154(b) by 0 days.

(21) Appl. No.: 17/803,357

(22) Filed: May 31, 2022

(65) Prior Publication Data

US 2022/0296993 A1 Sep. 22, 2022

Related U.S. Application Data

(63) Continuation-in-part of application No. 16/974,148, filed on Oct. 21, 2020, now abandoned.

(51) Int. Cl.
*A63F 9/08* (2006.01)

(52) U.S. Cl.
CPC ..... *A63F 9/0838* (2013.01); *A63F 9/0834* (2013.01)

(58) Field of Classification Search
CPC ..... A63F 9/0838; A63F 9/0834; A63F 9/34; A63F 9/0842
See application file for complete search history.

(56) References Cited

U.S. PATENT DOCUMENTS 4,462,596 A * 7/1984 Yamamoto ..... A63F 9/12 273/239
7,413,493 B2 * 8/2008 Toht ..... A63H 33/046 446/131
7,887,056 B2 * 2/2011 Tenorio ..... A63F 9/1208 273/156
8,850,683 B2 * 10/2014 Haughey ..... A63H 33/046 446/124
9,821,244 B1 * 11/2017 Whang ..... A63H 33/046
11,224,821 B2 * 1/2022 Rosen ..... H01F 7/0221
11,484,780 B1 * 11/2022 Jiang ..... A63F 9/34
2015/0076766 A1 * 3/2015 Liu ..... A63F 9/0842 273/153 S
2021/0153366 A1 * 5/2021 Osipov ..... H05K 5/0217
2022/0118354 A1 * 4/2022 Osipov ..... A63F 9/0842
2022/0296994 A1 * 9/2022 Osipov ..... A63F 9/0865

FOREIGN PATENT DOCUMENTS

CN 108568089 A * 9/2018 ..... A63F 9/0842
CN 112190916 A * 1/2021
CN 113230645 A * 8/2021 ..... A63F 9/0826
KR 20210127314 A * 10/2021
WO WO-2009118462 A1 * 10/2009 ..... A63F 9/0842

* cited by examiner

*Primary Examiner* — Steven B Wong

(57) ABSTRACT

Disclosed herein is the 3-D puzzle implemented as a cube consisting of eight movable sectors configured to move about a central cross-piece created by three axels that are perpendicular to each other. Each movable sector includes three movable elements positioned orthogonally to each other. Each movable element has an outer edge surface attached to a holder. The holders of the three movable elements form a central cross inside the movable sector. The central cross allows the three movable elements to assume positions where the movable element is extracted or retracted relative to the hosting movable sector. Each holder of the movable element has a magnet positioned inside. The central piece of the 3-D cubical puzzle is formed by a central cross made of three orthogonal axes with flat ends configured to fix the movable elements in a static position and to move from one static position into another.

5 Claims, 20 Drawing Sheets

CUBICAL 3-D MAGNETIC PUZZLE WITH MOVABLE SECTORS

CROSS-REFERENCE TO RELATED APPLICATION

This application is a CIP of the U.S. patent application Ser. No. 16/974,148 filed on 10.21.2020 and currently unintentionally abandoned.

BACKGROUND

There are currently several magnetic puzzles available. A magnetic puzzle with movable sectors is disclosed in RF Patent No. 2667861, published in 2018. The disclosed puzzle uses magnetic fields to change the state of the puzzle. However, the disclosed puzzle is rather simple and easy to solve.

Accordingly, a complex and hard to solve cubical 3-D puzzle with magnets and movable sectors is desired.

SUMMARY OF THE INVENTION

Disclosed herein is the 3-D puzzle implemented as a cube consisting of eight movable sectors configured to move about a central cross-piece created by three axels that are perpendicular to each other. Each movable sector includes three movable elements positioned orthogonally to each other. Each movable element has an outer edge surface attached to a holder. The holders of the three movable elements form a central cross inside the movable sector. The central cross allows the three movable elements to assume positions where the movable element is extracted or retracted relative to the hosting movable sector. Each holder of the movable element has a magnet positioned inside. The central piece of the 3D cubical puzzle is formed by a central cross made of three orthogonal to each other axes with flat ends configured to fix the movable elements in a static position and to move them from one static position into another.

These and other features of the concepts provided herein will become more apparent to those of skill in the art in view of the accompanying drawings and following description, which describe particular embodiments of such concepts in greater detail.

BRIEF DESCRIPTION OF DRAWINGS

A more particular description of the present disclosure will be rendered by reference to specific embodiments thereof that are illustrated in the appended drawings. It is appreciated that these drawings depict only typical embodiments of the invention and are therefore not to be considered limiting of its scope. Example embodiments of the invention will be described and explained with additional specificity and detail through the use of the accompanying drawings in which.

DETAILED DESCRIPTION

Figure 1:
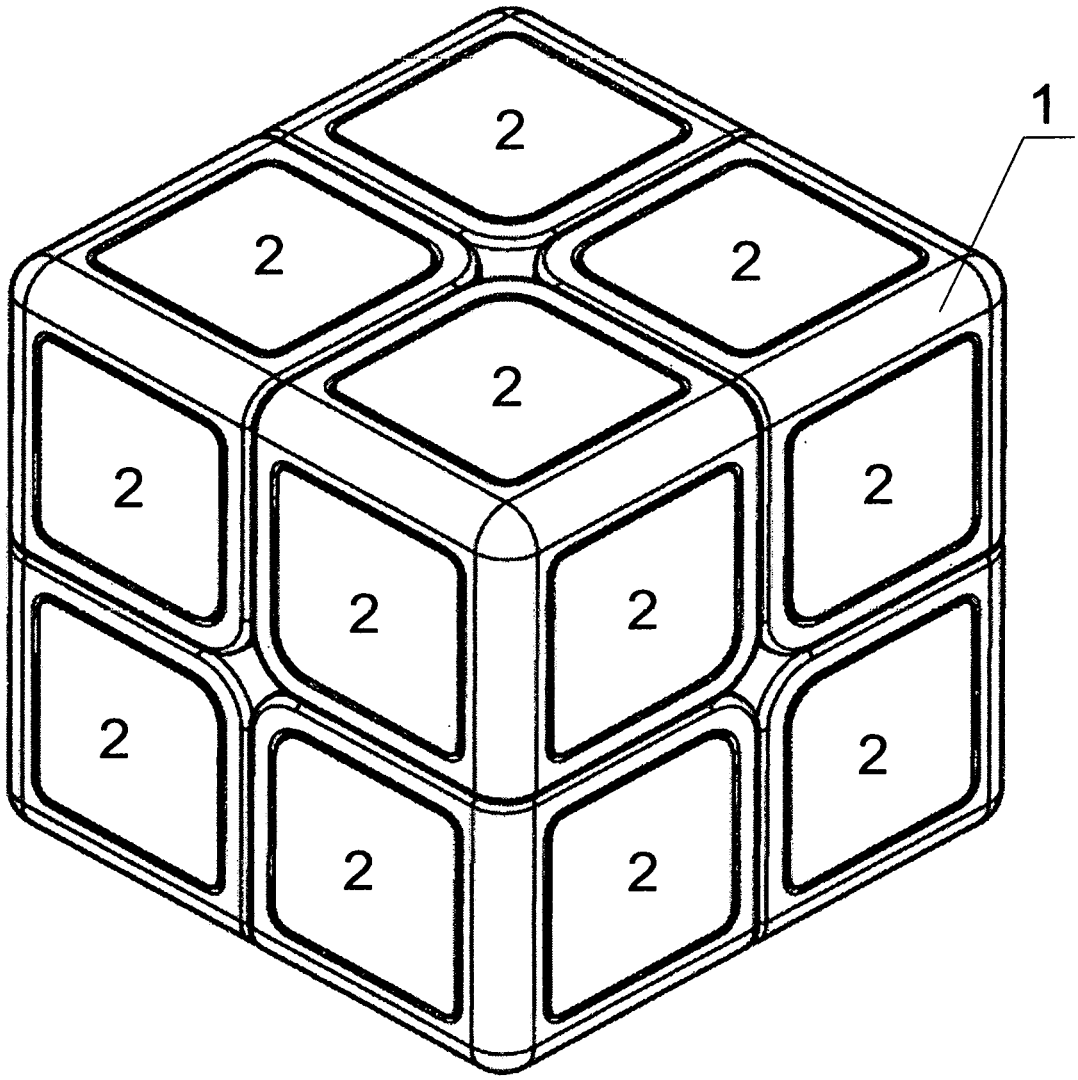
FIG. 1 illustrates a view of the 3-D cubic puzzle in an initial ordered state, according to the exemplary embodiment.

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

For clarity, it is to be understood that the word "distal" refers to a direction relatively closer to a patient on which a medical device is to be used as described herein, while the word "proximal" refers to a direction relatively further from the patient. Also, the words "including," "has," and "having," as used herein, including the claims, shall have the same meaning as the word "comprising."

Lastly, in the following description, the terms "or" and "and/or" as used herein are to be interpreted as inclusive or meaning any one or any combination. As an example, "A, B or C" or "A, B and/or C" mean "any of the following: A; B; C; A and B; A and C; B and C; A, B and C." An exception to this definition will occur only when a combination of elements, components, functions, steps or acts are in some way inherently mutually exclusive.

Unless defined otherwise, all technical and scientific terms used herein have the same meaning as commonly understood by those of ordinary skill in the art.

Embodiments disclosed herein are directed to a 3-D cubical puzzle with movable sectors configured to be repositioned relative to each other. The sectors may have movable elements providing for various states of the 3-D puzzle.

According to the exemplary embodiments, the 3-D puzzle is implemented as a cube consisting of multiple movable sectors configured to move about a central piece. All movable sectors have movable elements attached to holders configured to house magnets. The relative positioning of the movable elements can be changed by a user. According to the exemplary embodiment, the magnets interact with each other by pairs in any static position of the cubical 3-D puzzle. As a result, the movable elements are either being pulled to the center or being pushed away from the center.

Accordingly, the elements of the cubic 3-D puzzle may move by a principle similar to the one of the Rubik cube®. However, the exemplary 3-D puzzle does not need to use colors for the movable sectors. Instead, the movable sectors of the cube use square button-like elements positioned on every movable sector. The button-like elements can be either in an extracted or pushed-in binary state.

Since the cubical 3-D puzzle has magnets positioned inside, at each turn of a segment of the puzzle, a new interaction of magnet pairs occurs. Magnetic pull/push causes repositioning of the movable sectors that change the appearance of the cubical 3-D puzzle.

In one embodiment, the plates with static magnets may be shaped as disks. Thus, regardless of a static position of the 3-D puzzle, the magnets always interact with each other by pairs causing the movable elements to be either pulled to the center or be pushed away from the center thereby creating different variations of the cubical 3-D puzzle.

In one embodiment, the plates housing the static magnets include an even number of magnets each. Thus, regardless of a static position of the cubical 3-D puzzle, the magnets always interact with each other by pairs.

Thanks to the above advantageous characteristics, it becomes possible to use the magnets and other movable elements made of a material with magnetic susceptibility as essential features of the puzzle structure itself in the absence of any guides. The multivariance of their location in different stationary positions of the segments of the spherical puzzle is provided by rotation and magnetic interaction and is used to increase the number of different positions of the cubical puzzle, which ensures its complexity and variety of possible positions.

Rotations of magnets and elements made of a material with magnetic susceptibility is facilitated by attraction and repulsion of various magnets. The proposed solution is simple and convenient to hold in user's hands, as well as to rotate and twist.

The FIGS. 1-23 described below use the following numbering of the exemplary features and elements:

1—movable sectors;
2—movable elements;
3—magnets;
4—central piece;
41—cross of the central piece;
42—part of the central piece;
43—axel part of the central piece;
5—outer surface of the movable element;
6—holder of the movable element; and
7—inner part of the movable element.

According to the exemplary embodiments, FIGS. 1-23 depict the 3-D cubical puzzle and its parts including movable sectors 1 configured to change the relative positions to each other. The movable sectors 1 are configured to host the retractable movable elements 2 with magnets 3 that allow to assume various states of the 3-D cubical puzzle. The movable sectors 1 may have cavities configured to accommodate the movable elements 2. Each movable element may move under influence of other movable elements as the movable sectors change their positions relative to each other.

As discussed above, the 3-D cubical puzzle is implemented with eight cubical movable sectors 1 attached to the central piece 4. Each movable sector 1 may include three movable elements 2 positioned orthogonally to each other. Each movable element 2 has an outer surface 5 connected to a holder 6. The holders 6 of the three movable elements 2 form a holder cross inside the movable sector 1. The holder cross allows for movement of the three movable elements to cause the movable elements 2 assume either an extracted or pushed-in position relative to the hosting movable sector. Each of the holder of the movable element has a magnet located inside.

A central piece 4 consists of a central cross 41 made of three orthogonal axes with flat ends configured to fix the movable elements 2 in a stationary position of the 3-D puzzle and to move to another stationary position of the 3-D puzzle by employing the part 42 of the central piece and an axel part 43 of the central piece 4.

Figure 2:
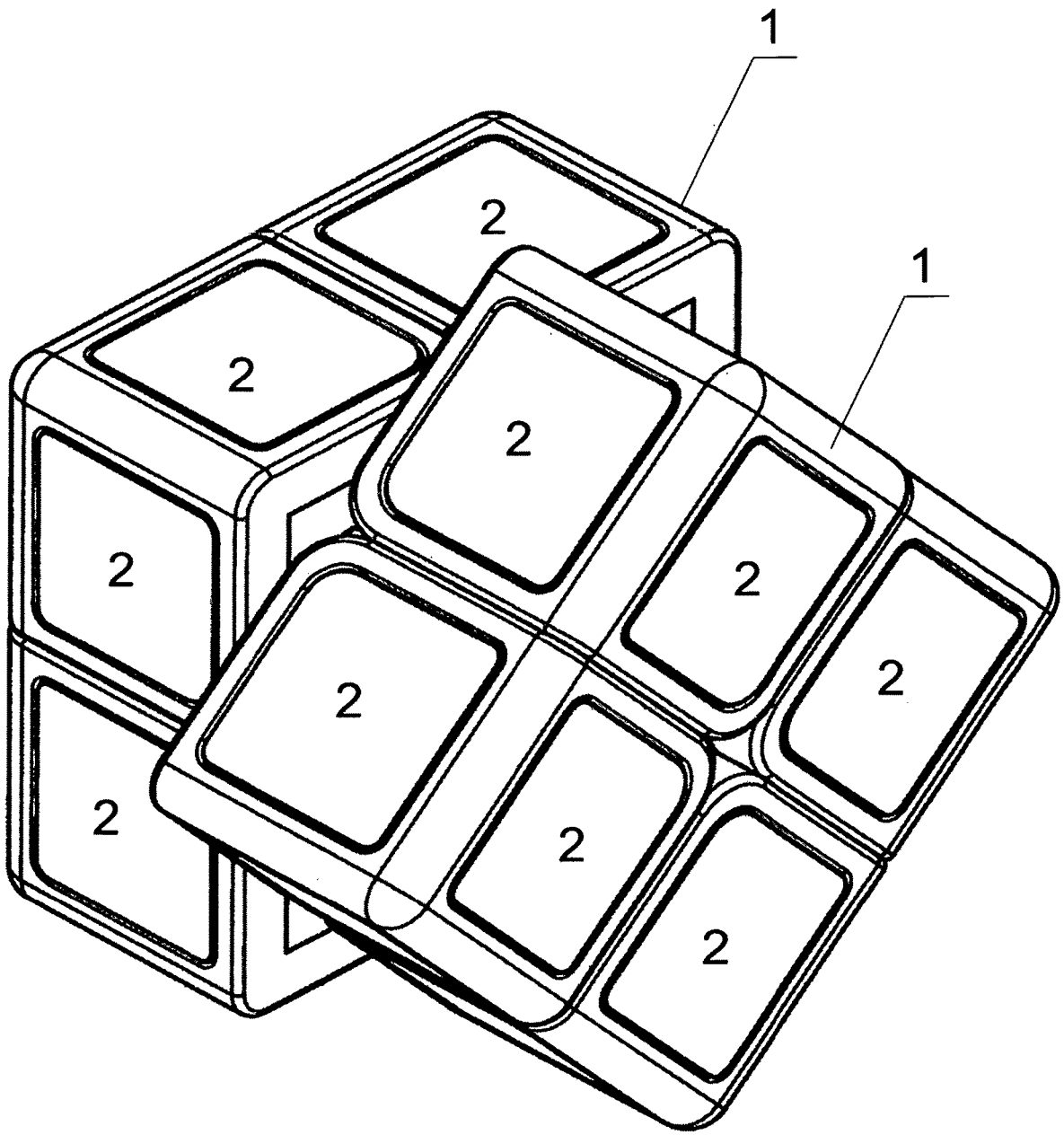
FIG. 2 illustrates a view of the 3-D cubic puzzle in a rotated state when movable sectors are twisted relative to each other, according to the exemplary embodiment.
Figure 3:
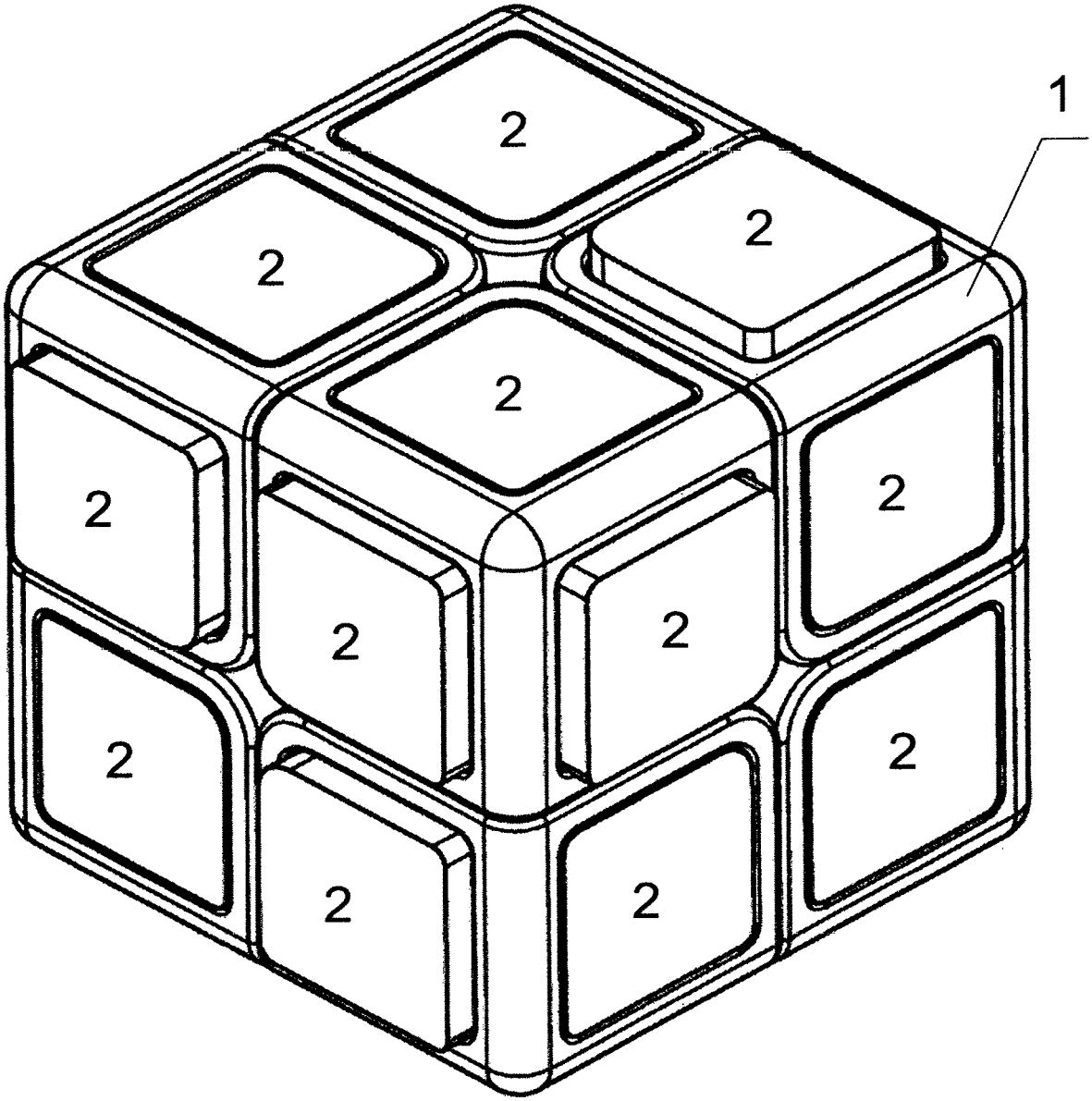
FIG. 3 illustrates a view of the 3-D cubic puzzle with extracted and retracted movable elements, according to the exemplary embodiment.
Figure 4:
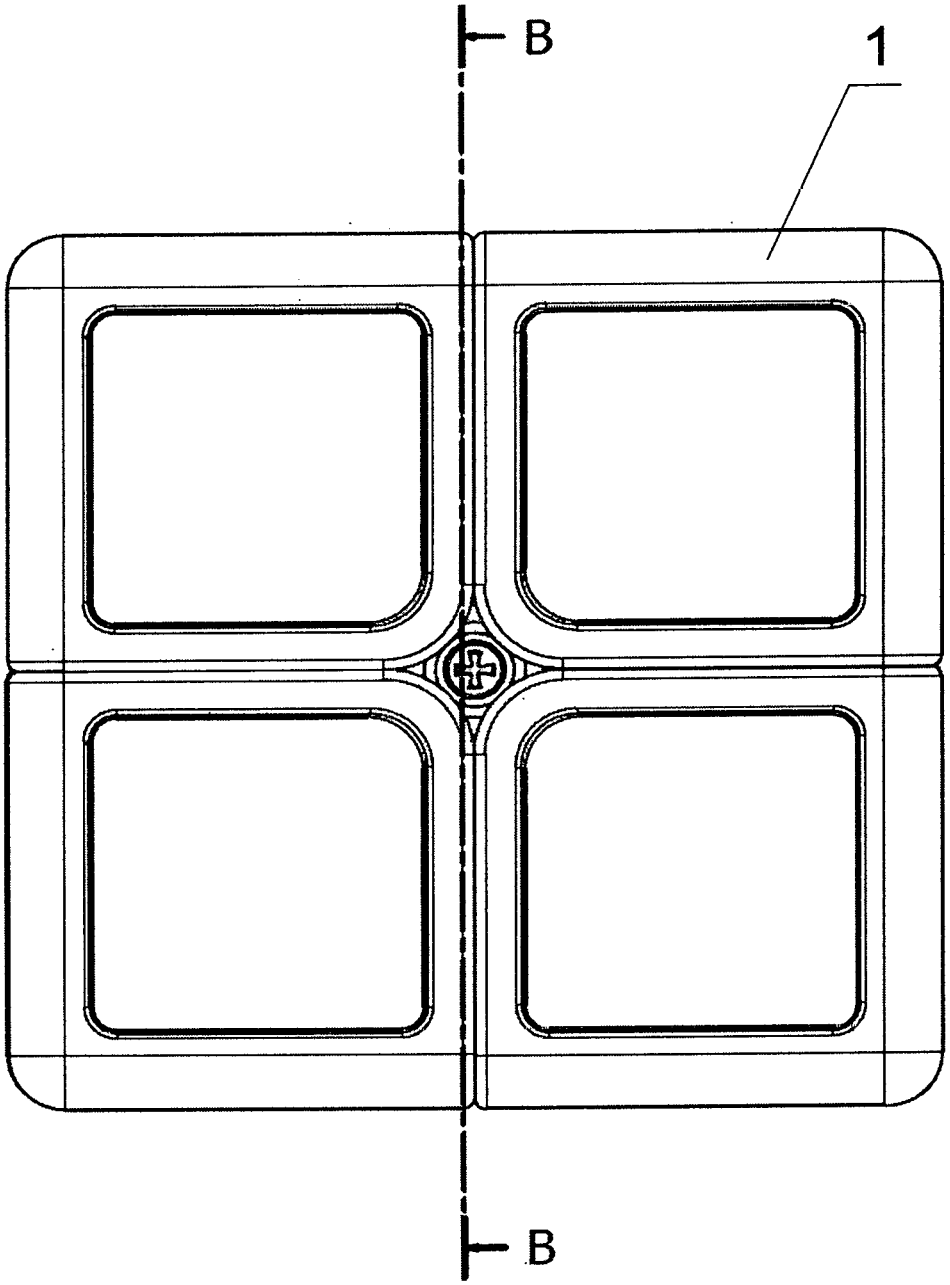
FIG. 4 illustrates a top view of the puzzle depicted in FIG. 1, according to the exemplary embodiment.
Figure 5:
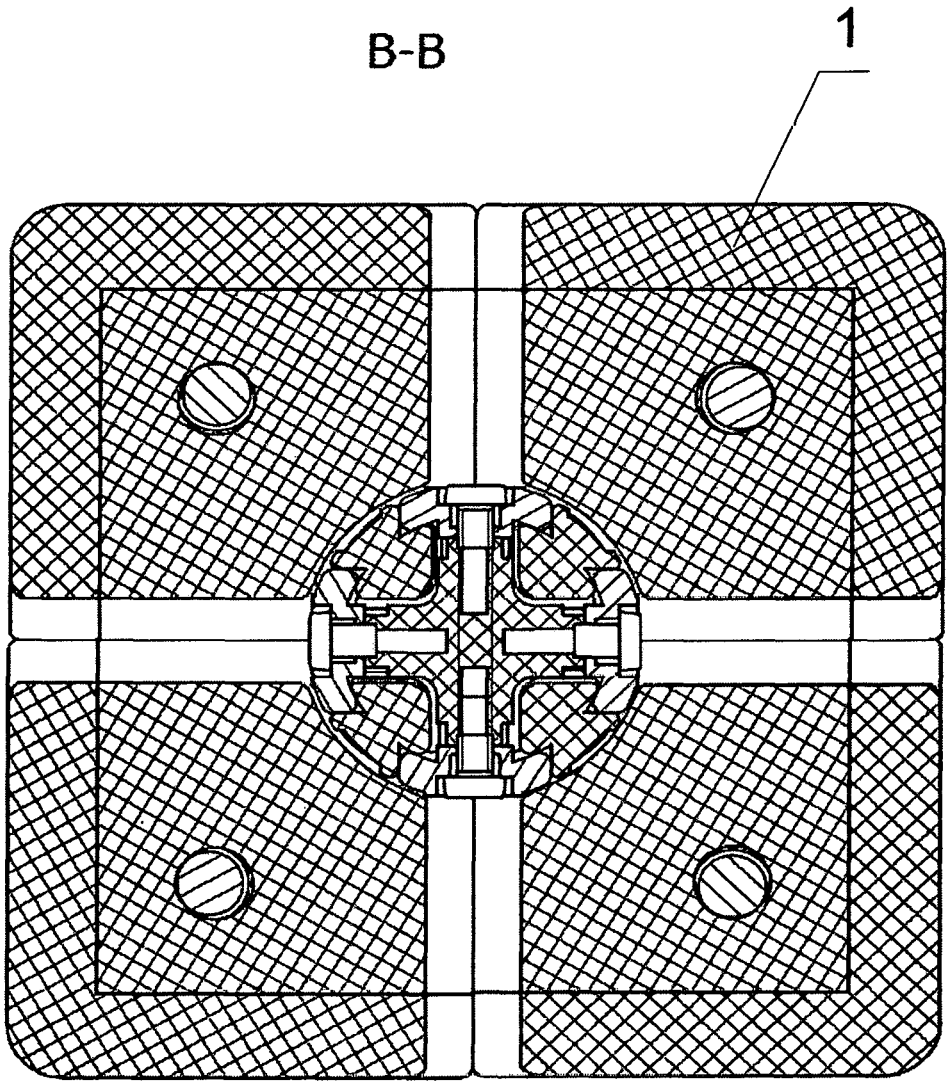
FIG. 5 illustrates a cross-section B-B view of the puzzle depicted in FIG. 4, according to the exemplary embodiment.
Figure 6:
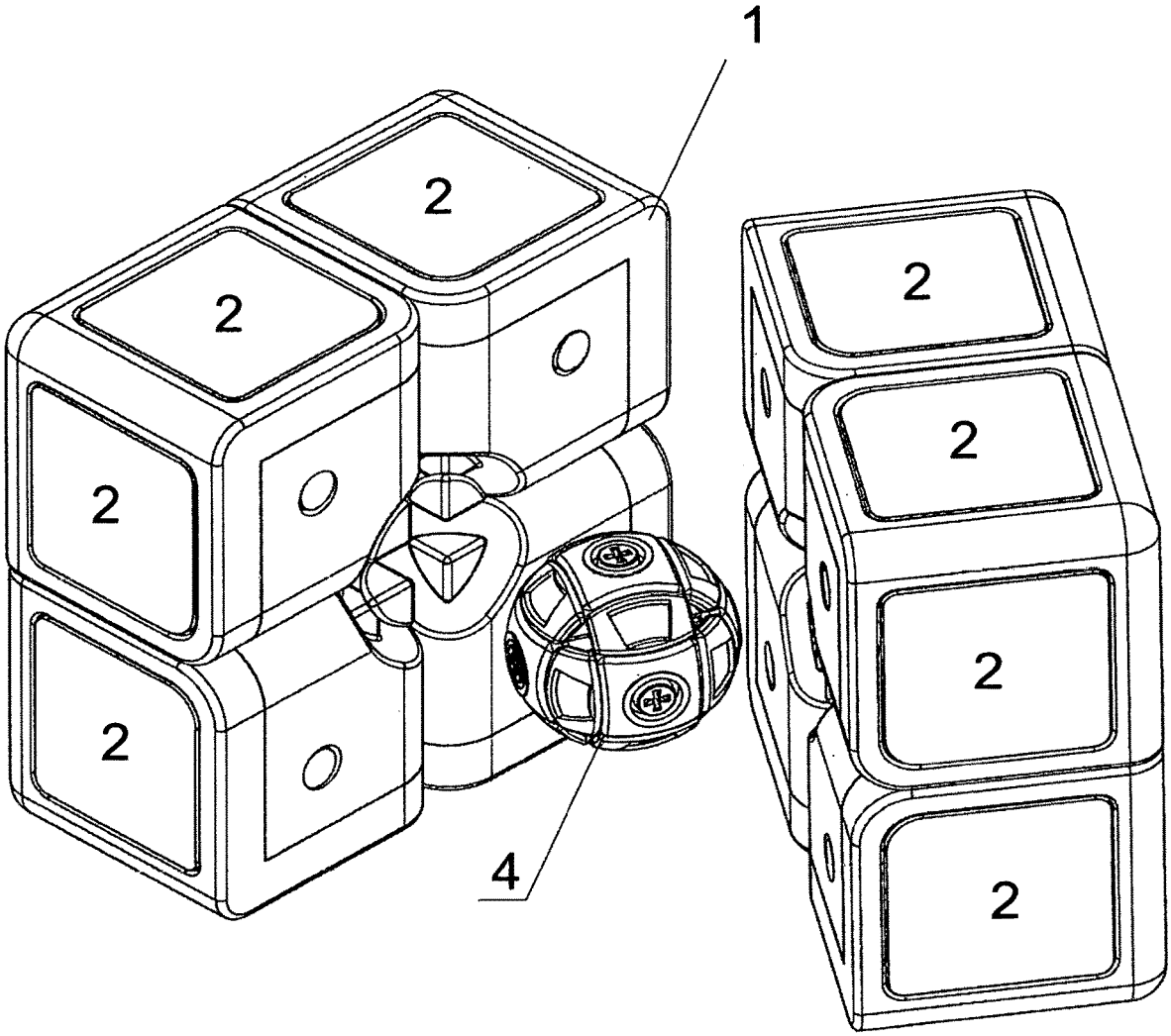
FIG. 6 illustrates a disassembled 3-D cubic puzzle with a separate center piece, according to the exemplary embodiment.
Figure 7:
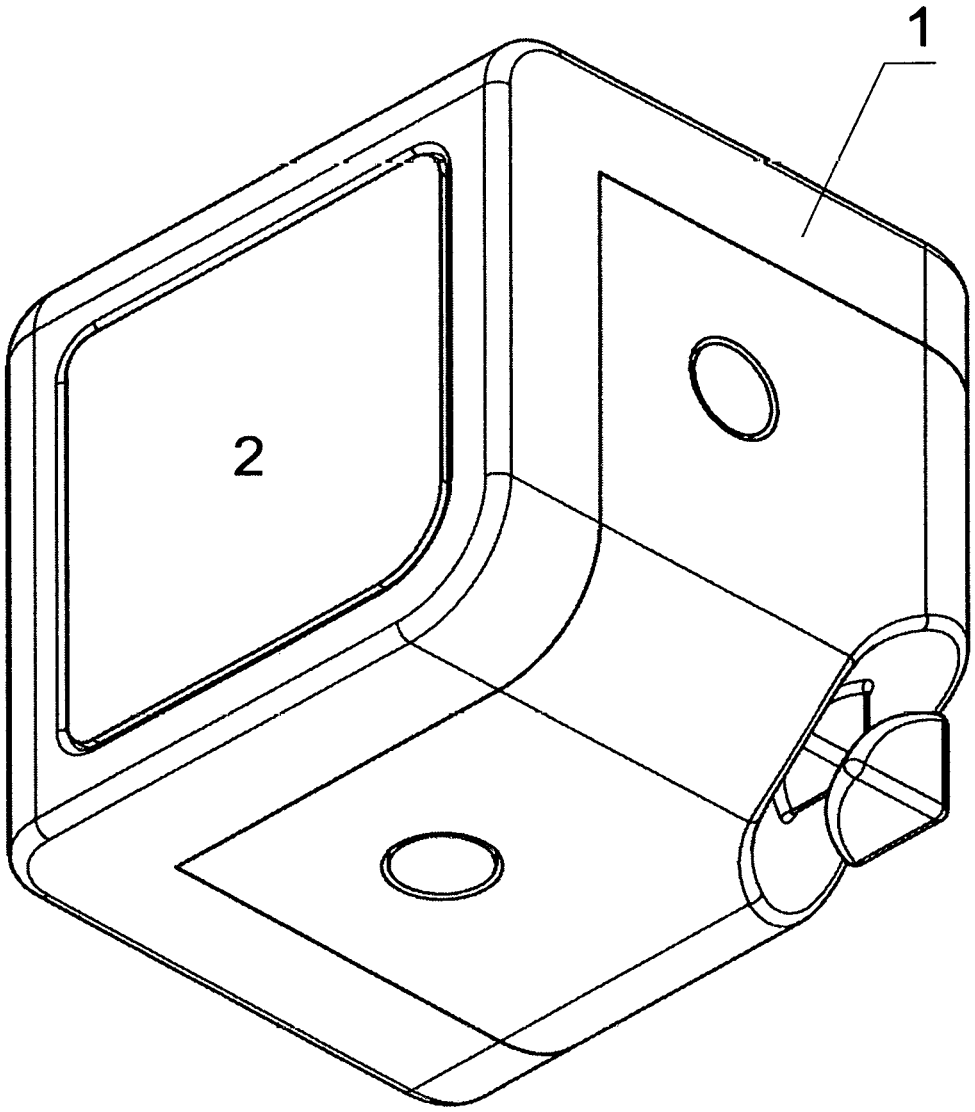
FIG. 7 illustrates a movable sector of the 3-D puzzle, according to the exemplary embodiment.
Figure 8:
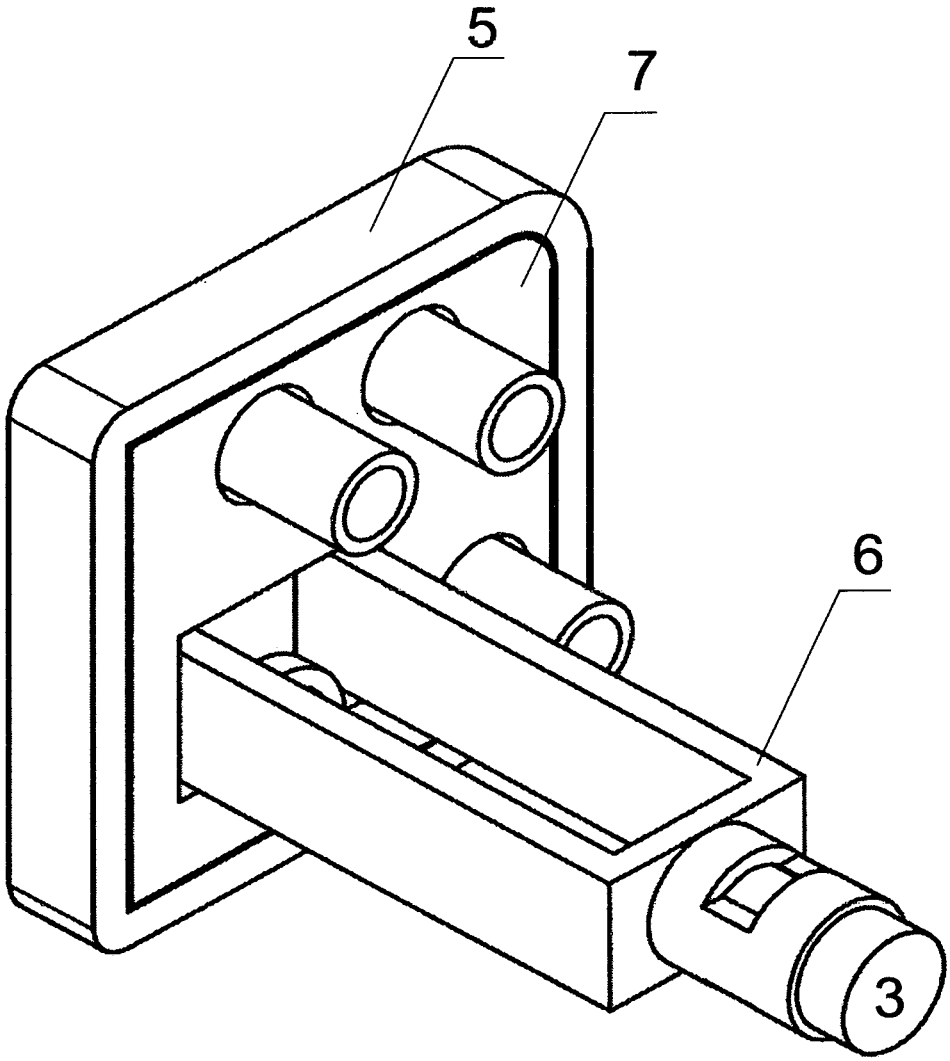
FIG. 8 illustrates a movable element of the 3-D puzzle, according to the exemplary embodiment.
Figure 9:
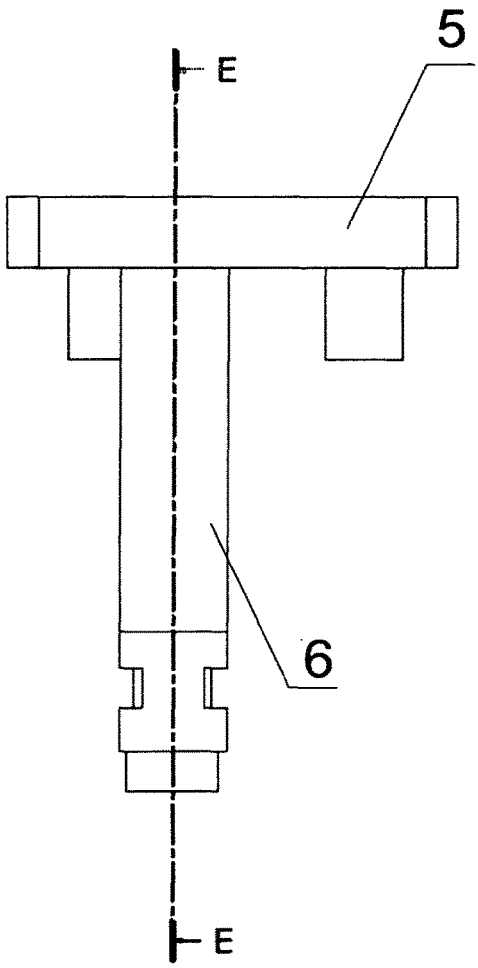
FIG. 9 illustrates a side view of the movable element depicted in FIG. 8, according to the exemplary embodiment.
Figure 10:
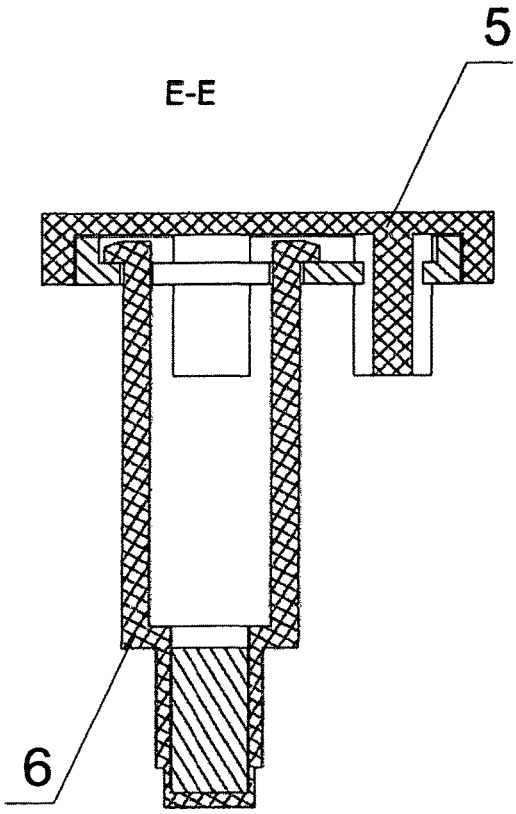
FIG. 10 illustrates a cross-section E-E of the movable element depicted in FIG. 8, according to the exemplary embodiment.
Figure 11:
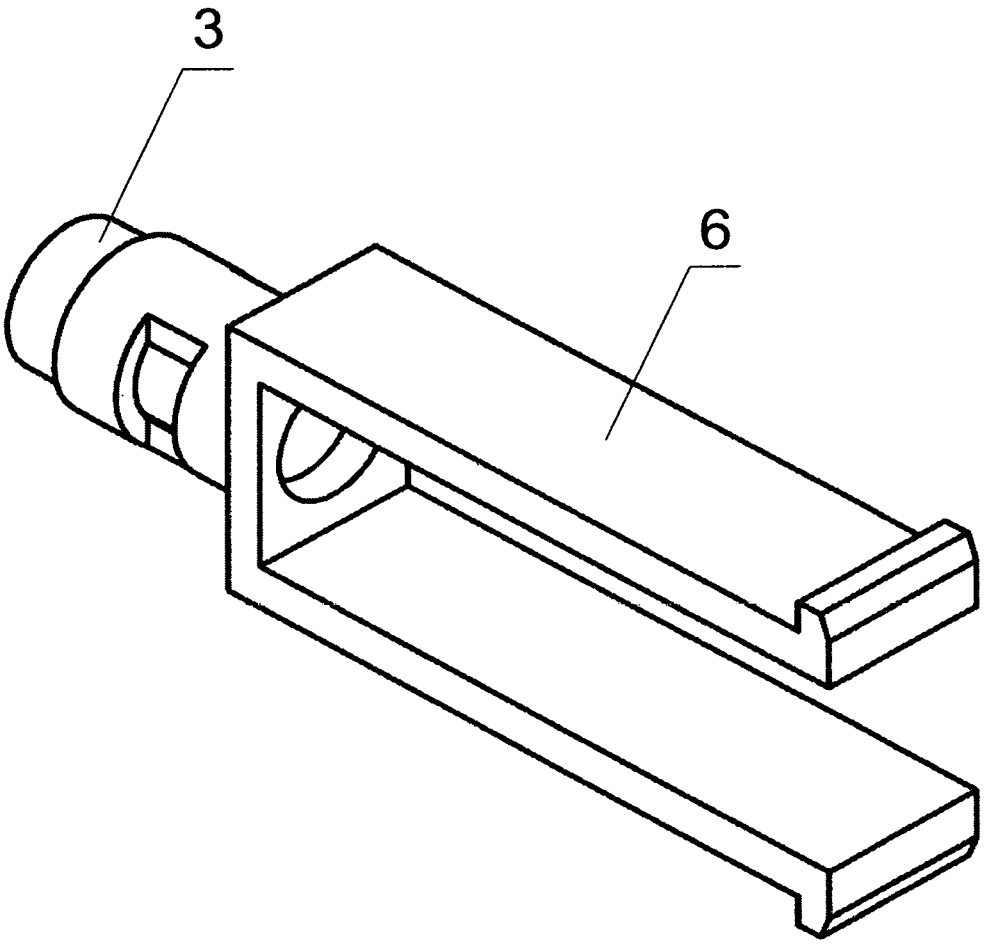
FIG. 11 illustrates a holder of the movable element, according to the exemplary embodiment.
Figure 12:
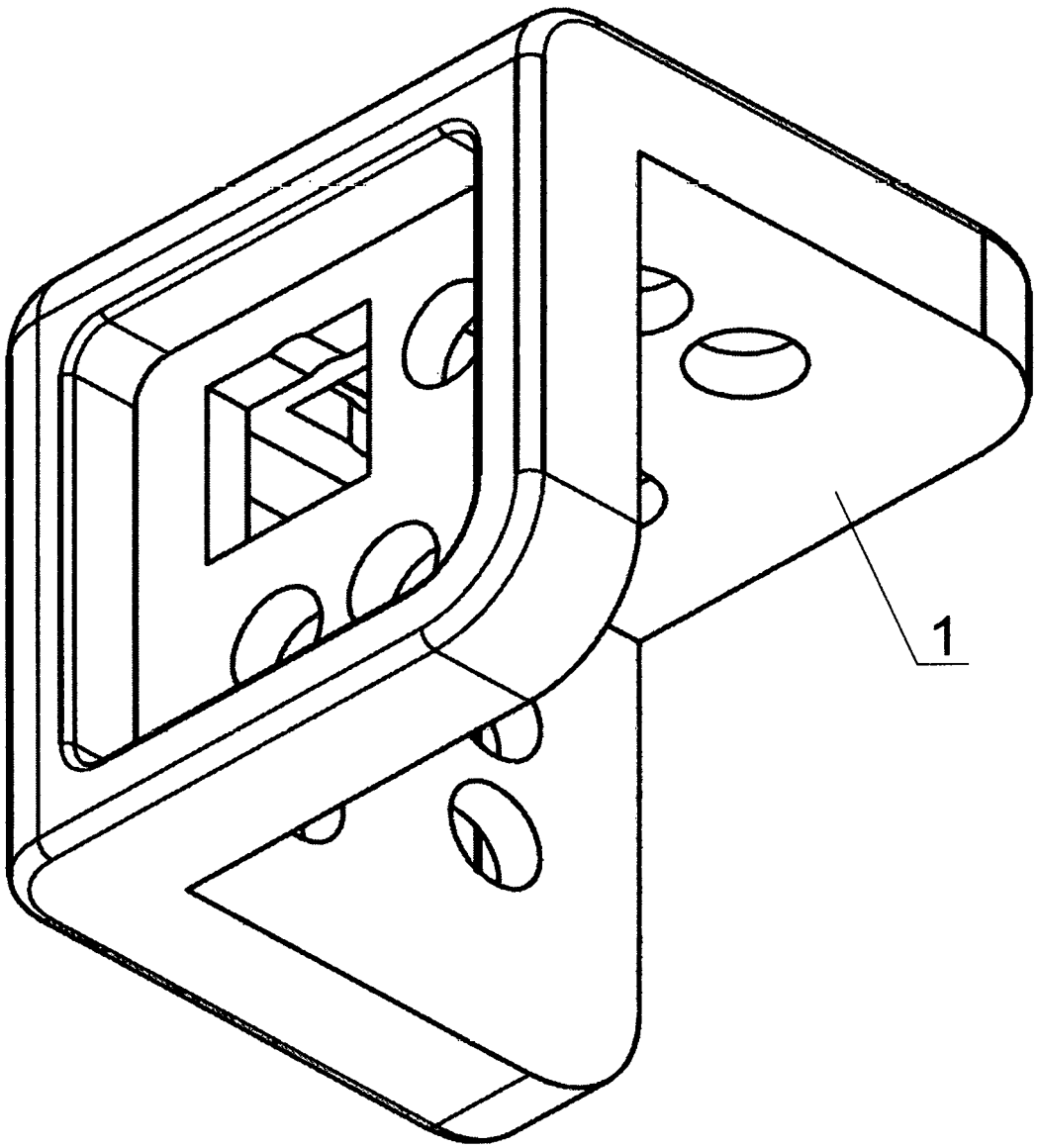
FIG. 12 illustrates another view of the movable sector of the 3-D puzzle depicted in FIG. 1, according to the exemplary embodiment.
Figure 13:
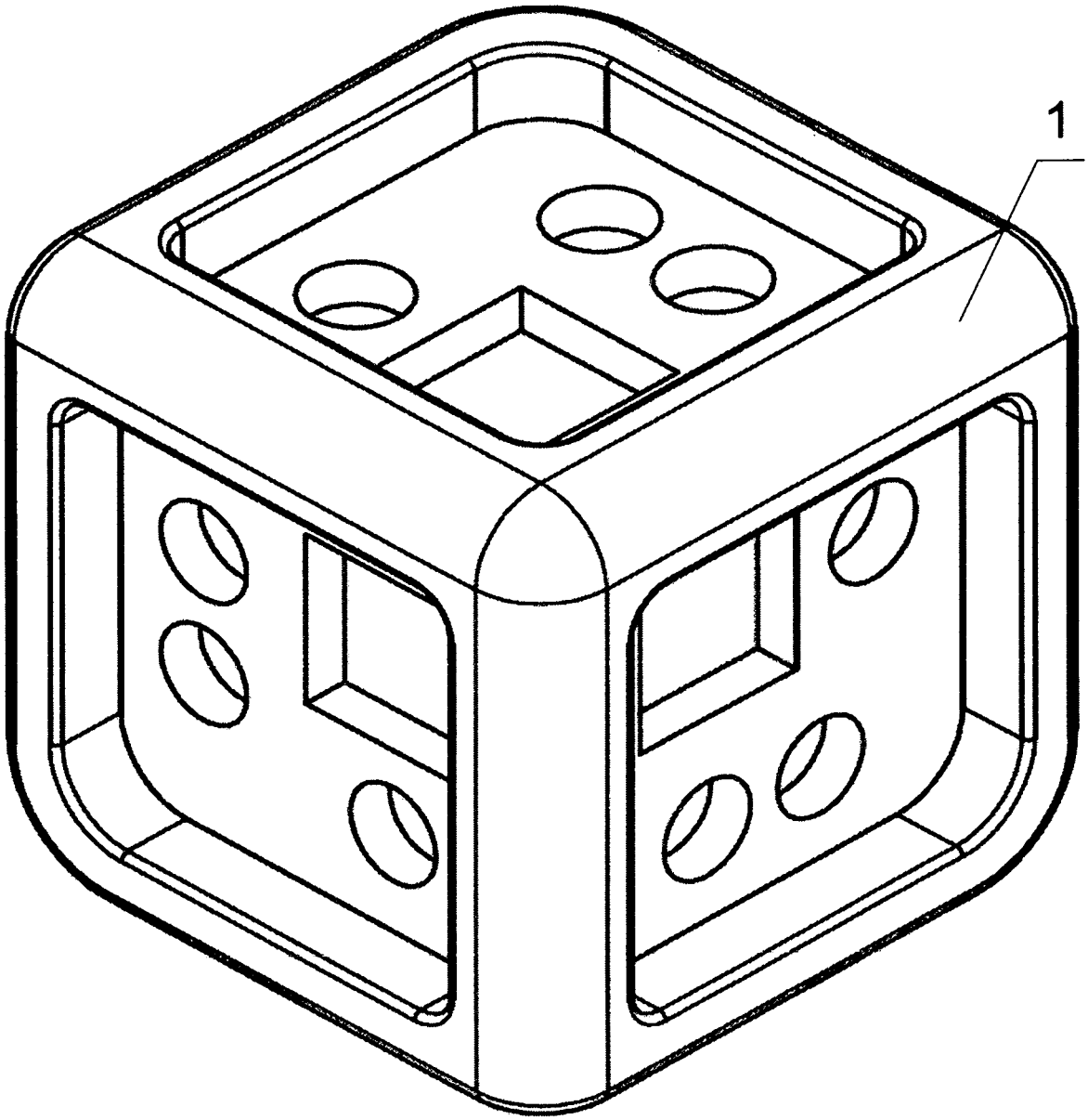
FIG. 13 illustrates a view of the movable sector of the 3-D puzzle depicted in FIG. 1, according to the exemplary embodiment.
Figure 14:
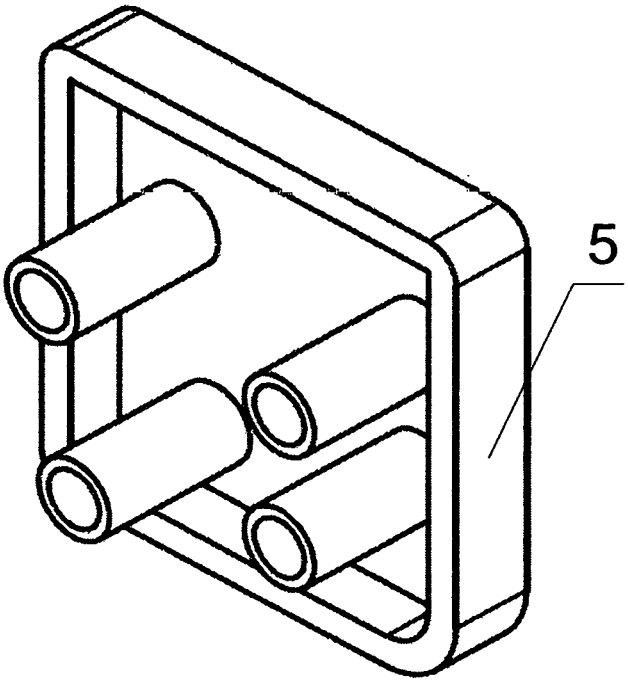
FIG. 14 illustrates a retractable part of the movable element of the 3-D puzzle depicted in FIG. 1, according to the exemplary embodiment.
Figure 15:
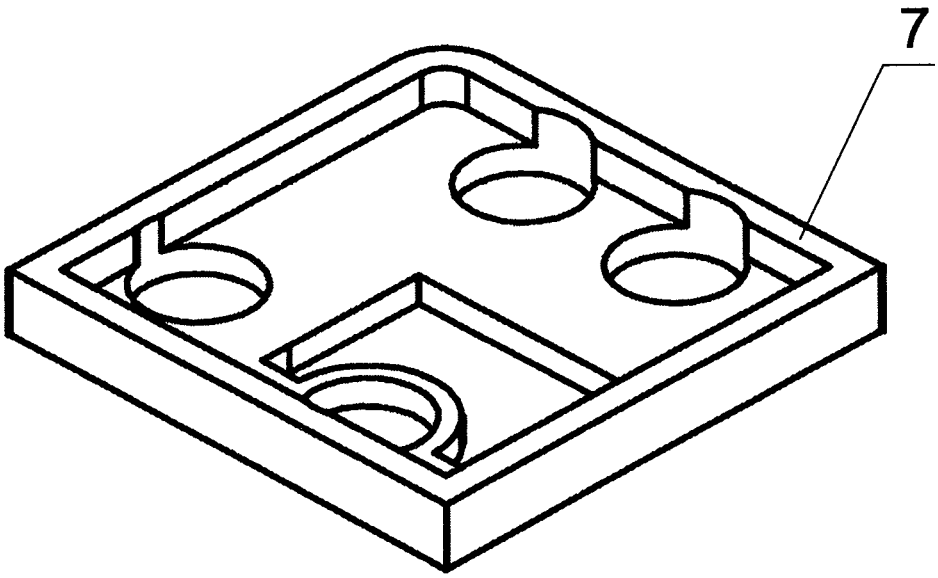
FIG. 15 illustrates an inner part of the retractable part of the movable element of the 3-D puzzle depicted in FIG. 1, according to the exemplary embodiment.
Figure 16:
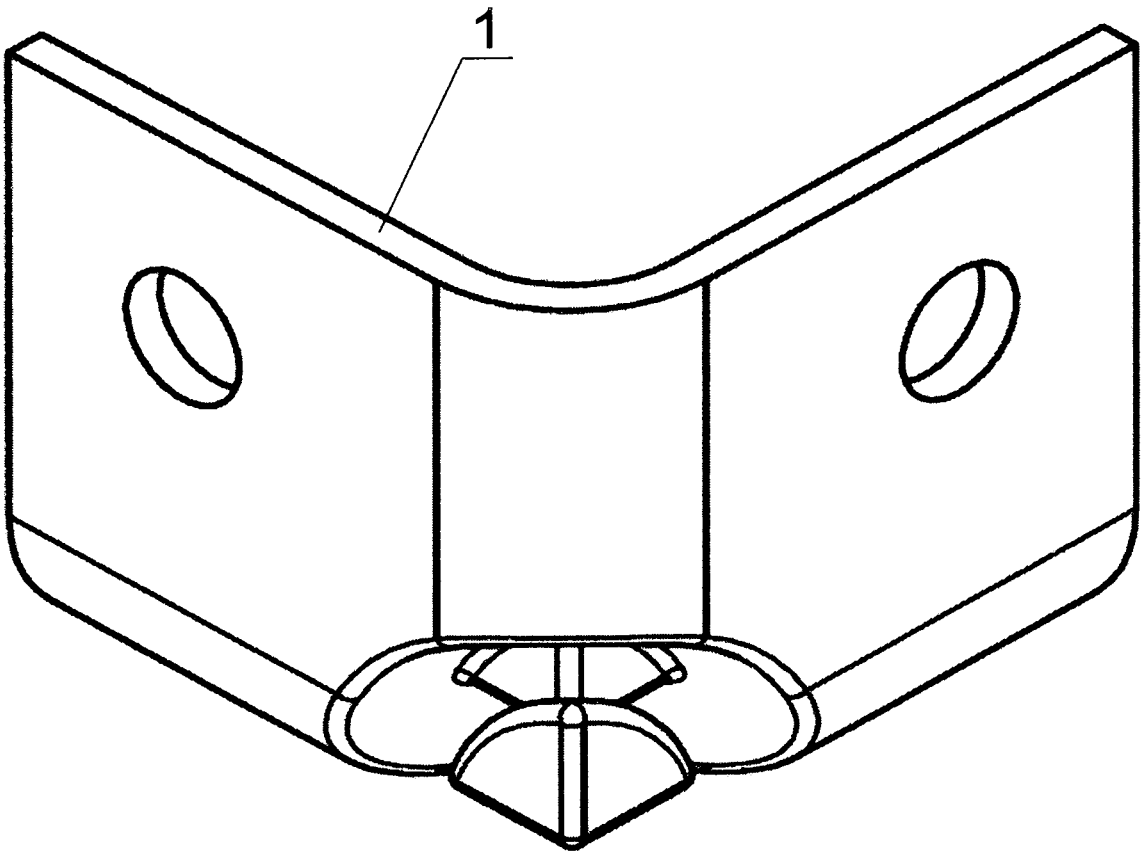
FIG. 16 illustrates an additional view of the movable sector of the 3-D puzzle depicted in FIG. 1, according to the exemplary embodiment.
Figure 17:
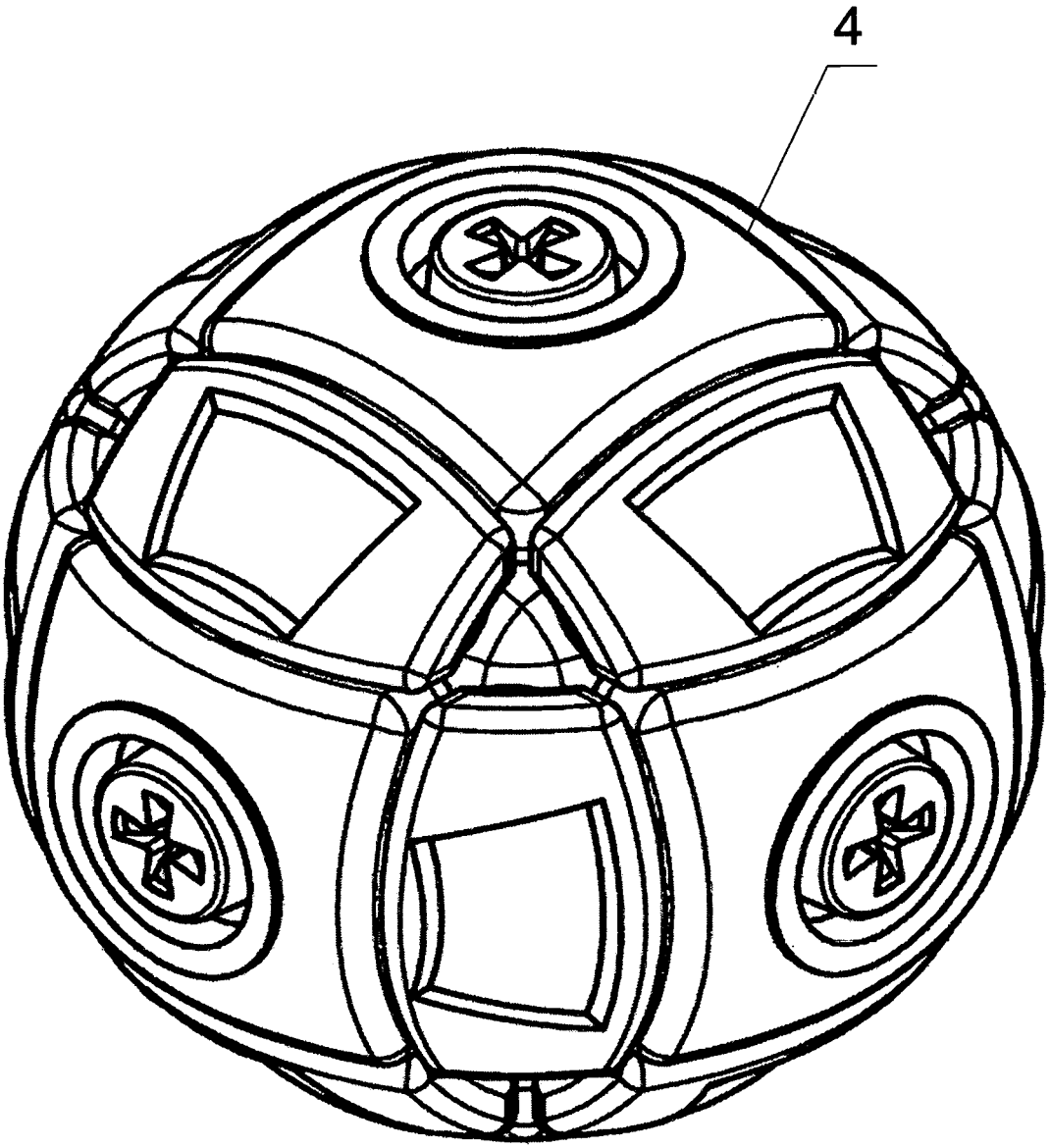
FIG. 17 illustrates a central piece of the 3-D puzzle depicted in FIG. 1, according to the exemplary embodiment.
Figure 18:
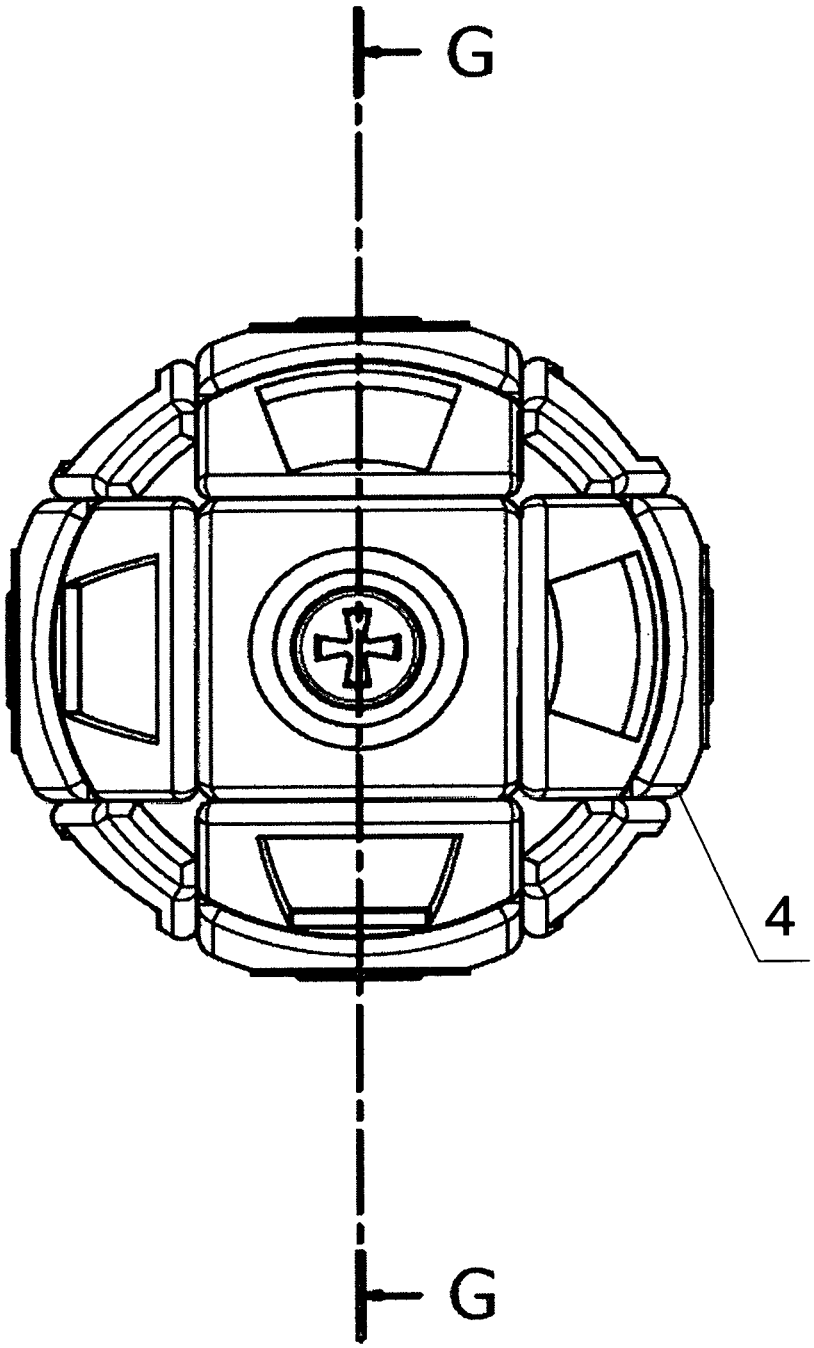
FIG. 18 illustrates another view of the central piece of the 3-D puzzle depicted in FIG. 1, according to the exemplary embodiment.
Figure 19:
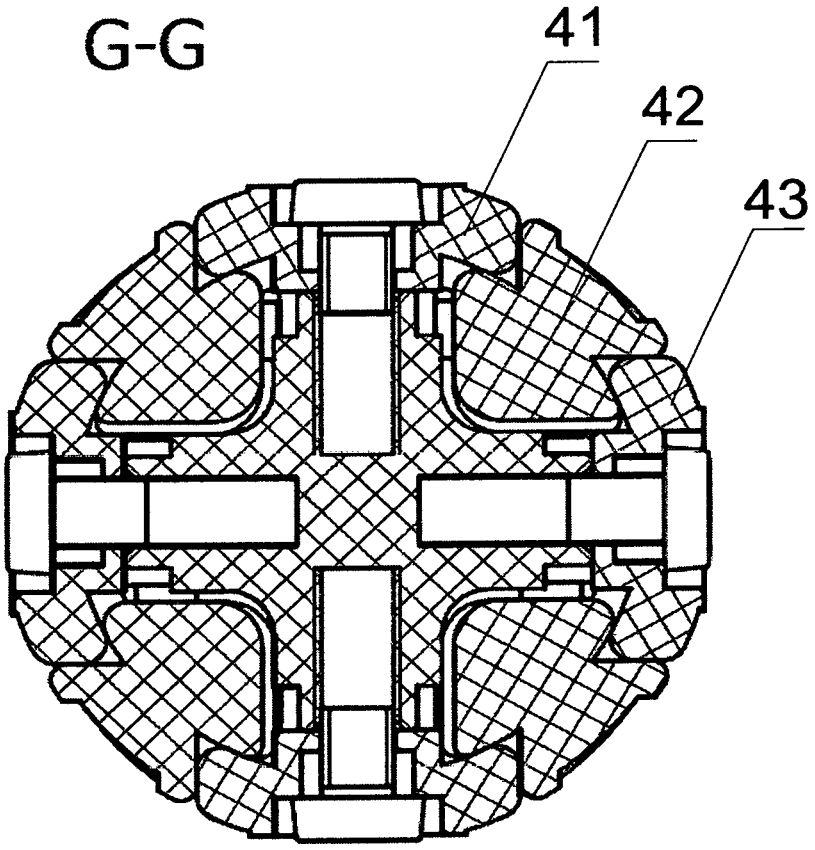
FIG. 19 illustrates a cross-section view G-G of the central piece depicted in FIG. 18, according to the exemplary embodiment.
Figure 20:
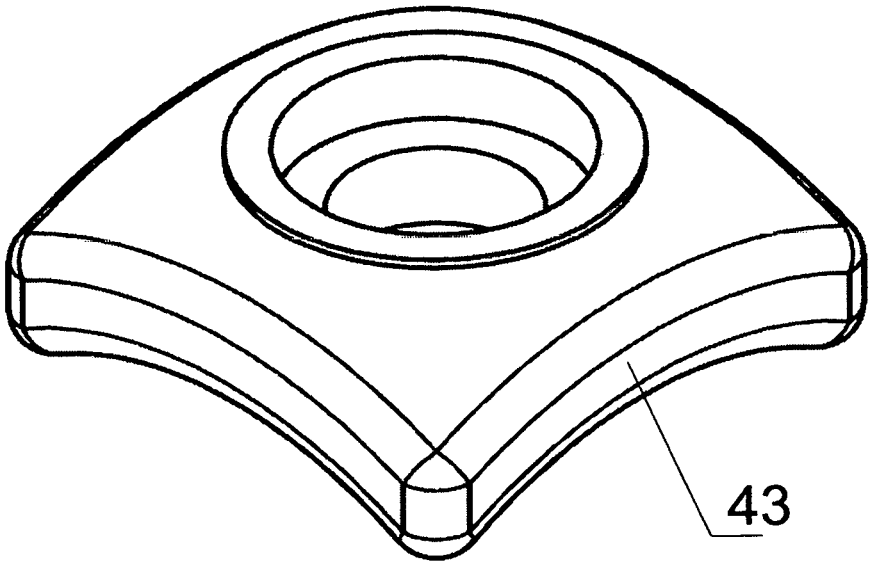
FIG. 20 illustrates an axel part of the central piece depicted in FIG. 18, according to the exemplary embodiment.
Figure 21:
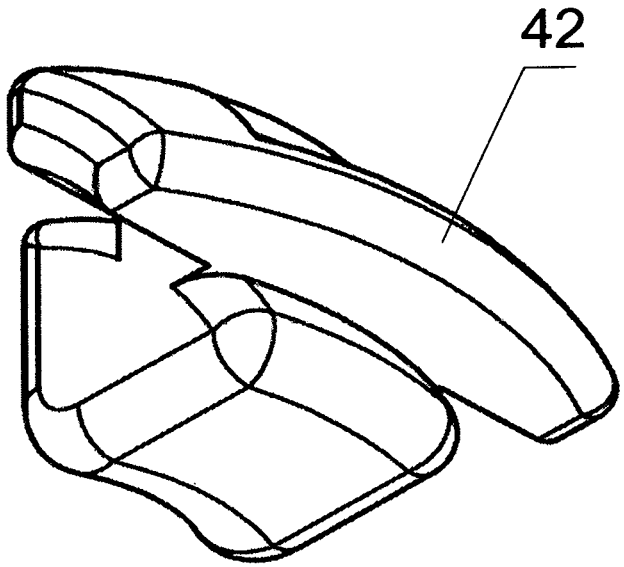
FIG. 21 illustrates another part of the central piece depicted in FIG. 18, according to the exemplary embodiment.
Figure 22:
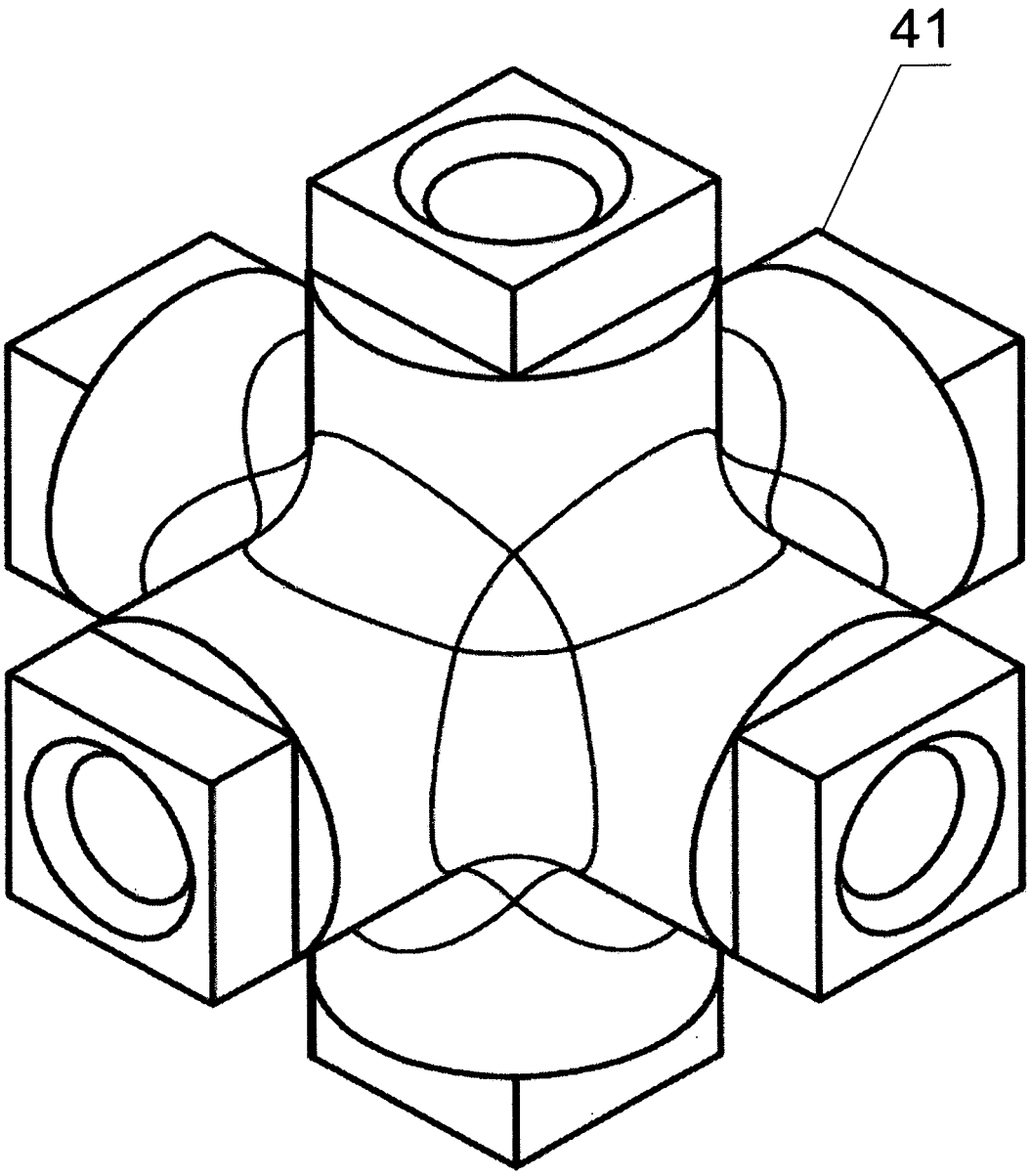
FIG. 22 illustrates a cross of the central piece depicted in FIG. 18, according to the exemplary embodiment.
Figure 23:
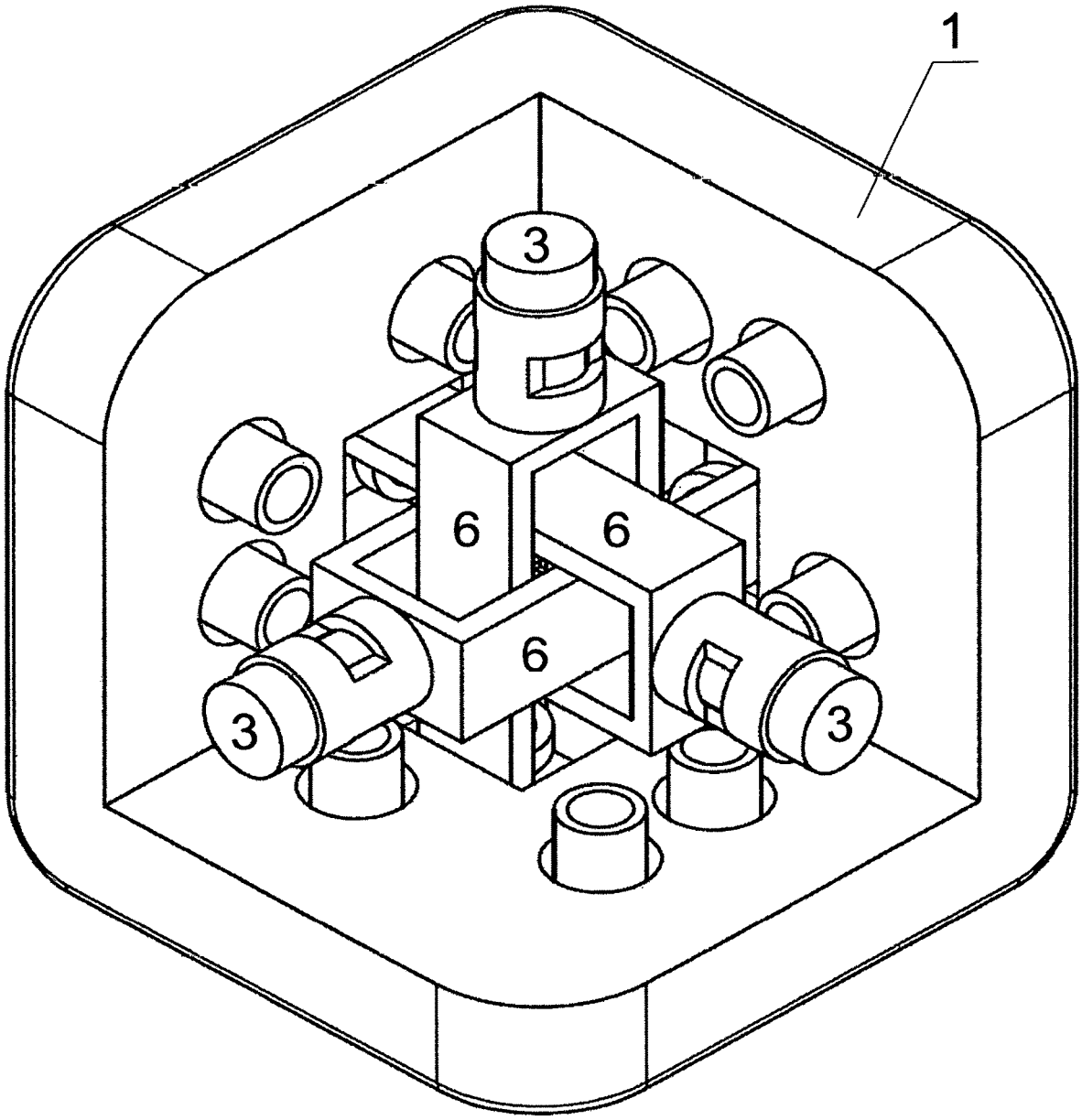
FIG. 23 illustrates an assembly of the movable sector including the movable elements, according to the exemplary embodiment.

According to the exemplary embodiment, the cubical 3-D puzzle is configured in such manner that the movable elements have two distinct positions—extracted and retracted. As shown in FIG. 3, some movable elements 2 are extracted and some are pushed-in. In the initial state, all movable elements 2 are in the pushed-in position. As shown in FIG. 2, once the movable sectors 1 are displaced, the 3-D puzzle assumes an intermediary state shown in FIG. 3.

Some magnets 3 located on the holders 6 interact with each other—i.e., push or pull. The push or pull force makes the holders 6 to change the positions of the attached movable elements 2 from pushed-in to extracted and vice versa depending on pushing or pulling of the magnets 3 of the adjacent holders 6.

The player's task is to first confuse the state of the puzzle, for example, so that the movable elements are in placed into a pushed-in or extracted position randomly. Then, the player has to collect from the out of order state all the sides of the cube puzzle so all movable elements are in the same state. Practice shows that this is a tricky and non-trivial task that can take a lot of time. When the movable sectors 1 are moved, magnets 3 located in holders 6 interact with each other and change the positions of the movable elements 2 depending on the environment.

Embodiments of the invention may be embodied in other specific forms without departing from the spirit of the present disclosure. The described embodiments are to be considered in all respects only as illustrative yet not restrictive. The scope of the embodiments is, therefore, indicated by the appended claims rather than by the foregoing description. All changes that come within the meaning and range of equivalency of the claims are to be embraced within their scope.

What is claimed is:

1. A 3-D cubical magnetic puzzle, comprising:

eight movable sectors configured to host movable elements configured to change a state of the 3-D magnetic puzzle, wherein:

the movable sectors are configured to change their positioning relative to each other; and each of the movable sectors comprising three cavities configured to accommodate three movable elements attached to holders comprising magnets, wherein the movable elements are configured to move up and down inside the cavity responsive to a magnetic field provided by the magnets responsive to a change in positioning of the movable sectors relative to each other, wherein the holders of the movable elements of each of the movable sectors form a holder cross inside each of the movable sectors configured to provide for movements of the movable elements in order to assume pushed-in or extracted positions relative to the movable sector, and wherein the movable sectors are attached to a center piece comprising a central cross formed by three orthogonal axes with flat ends configured to fix the movable elements in a stationary position of the 3-D cubic magnetic puzzle and to facilitate movements of the movable elements into another stationary position of the 3-D cubical magnetic puzzle.

2. The 3-D cubical magnetic puzzle of claim 1, wherein each of the movable sectors comprises three movable elements orthogonally positioned to each other.

3. The 3-D cubical magnetic puzzle of claim 1, wherein each of the movable elements comprises an outer surface and one of the holders connected to the outer surface.

4. A method of a 3-D magnetic puzzle, comprising:

obtaining a cube-shaped 3-D magnetic puzzle comprising:

a plurality of movable sectors configured to host movable elements configured to change a state of the 3-D magnetic puzzle, wherein:

eight movable sectors configured to host movable elements configured to change a state of the 3-D magnetic puzzle, wherein:

the movable sectors are configured to change their positioning relative to each other; and each of the movable sectors comprising three cavities configured to accommodate three movable elements attached to holders comprising magnets, wherein the movable elements are configured to move up and down inside the cavity responsive to a magnetic field provided by the magnets responsive to a change in positioning of the movable sectors relative to each other, wherein the holders of the movable elements of each of the movable sectors form a holder cross inside each of the movable sectors configured to provide for movements of the movable elements in order to assume pushed-in or extracted positions relative to the movable sector, and wherein the movable sectors are attached to a center piece comprising a central cross formed by three orthogonal axes with flat ends configured to fix the movable elements in a stationary position of the 3-D cubic magnetic puzzle and to facilitate movements of the movable elements into another stationary position of the 3-D cubical magnetic puzzle.

5. The method of claim 4, further comprising rotating the movable sectors of the cube-shaped 3-D magnetic puzzle to bring the magnetic puzzle to an ordered state, wherein all of the movable elements are in a pushed-in position.

* * * * *